US006962457B2

(12) United States Patent
Forsse

(10) Patent No.: US 6,962,457 B2
(45) **Date of Patent: *Nov. 8, 2005**

(54) BINDER

(75) Inventor: Earl K. Forsse, Dana Point, CA (US)

(73) Assignee: Xporactive Concepts, Dana Point, CA (US)

( * ) Notice: Subject to any disclaimer, the term of this patent is extended or adjusted under 35 U.S.C. 154(b) by 133 days.

This patent is subject to a terminal disclaimer.

(21) Appl. No.: 10/417,918

(22) Filed: Apr. 16, 2003

(65) Prior Publication Data

US 2003/0194262 A1 Oct. 16, 2003

Related U.S. Application Data

(60) Provisional application No. 60/372,989, filed on Apr. 16, 2002.

(51) Int. Cl.[7] ..... B42F 3/02

(52) U.S. Cl. ..... 402/55; 281/15.1; 281/21.1; 402/19; 402/46; 402/73; 402/80 R; 402/502; D19/26

(58) Field of Search ..... 402/3, 4, 19, 20, 402/26, 31, 33, 36–39, 41, 44, 46, 55, 56, 402/70, 73, 80 R, 80 P, 500, 502; 281/15.1, 281/21.1, 27.1, 29, 31; D19/26, 27

(56) References Cited

U.S. PATENT DOCUMENTS 706,949 A * 8/1902 Irving ..... 402/44
737,317 A * 8/1903 Barrett ..... 402/76
802,124 A * 10/1905 Trussell ..... 402/44
806,873 A * 12/1905 Crowder ..... 402/44
1,838,717 A * 12/1931 Strubing et al. ..... 402/76
2,252,422 A * 8/1941 Unger ..... 402/44
4,400,107 A * 8/1983 Pitts ..... 402/4
5,338,125 A 8/1994 Forsse et al.
5,667,324 A * 9/1997 Aoki ..... 402/46
5,716,153 A * 2/1998 Aiello ..... 402/46
5,807,176 A 9/1998 Forsse et al.
5,827,004 A * 10/1998 Kim ..... 402/46
5,993,099 A * 11/1999 Greenberg et al. ..... 402/4
6,086,280 A 7/2000 Ramich
6,126,353 A 10/2000 Mullin et al.
6,126,354 A 10/2000 Ramich
6,247,729 B1 6/2001 Kaufman
6,305,714 B1 * 10/2001 Rossetto et al. ..... 281/37
6,367,842 B1 * 4/2002 Wien et al. ..... 281/37

* cited by examiner

*Primary Examiner*—Monica S. Carter
(74) *Attorney, Agent, or Firm*—Kelly Lowry & Kelley LLP

(57) ABSTRACT

A binder for receiving and retaining papers includes first and second strips slidably connected to one another. Each strip includes spaced-apart fingers extending upwardly therefrom. The fingers of the first and second strips are offset from one another when the first and second strips are in a closed position. The first and second strips include releasable locking catches to retain the strips in a closed position, and release tabs for selectively moving the second strip into the open position. A cover having living hinges is attached to a lower surface of the first strip. The cover may include pockets on an outer surface thereof for accepting inserts, such as file hangers or printed labels.

17 Claims, 6 Drawing Sheets

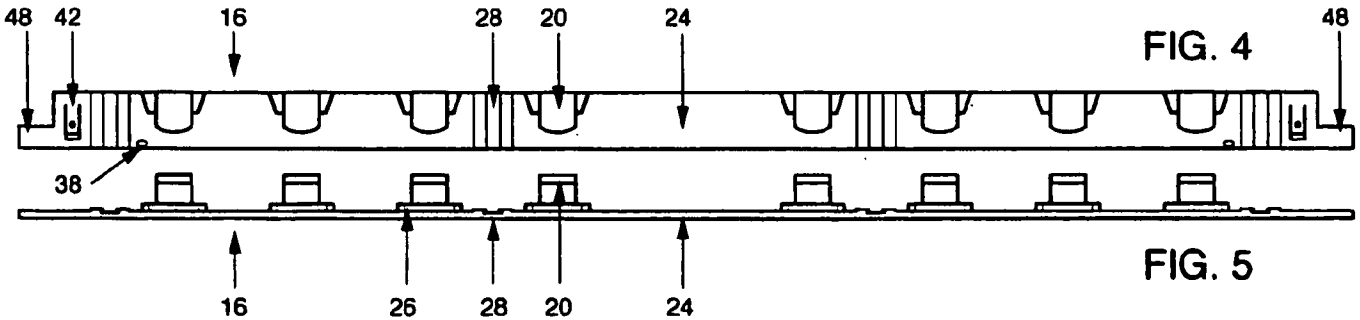
FIG. 4
FIG. 5
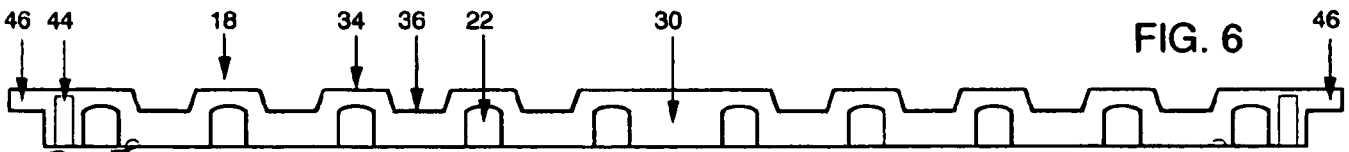
FIG. 6
FIG. 7
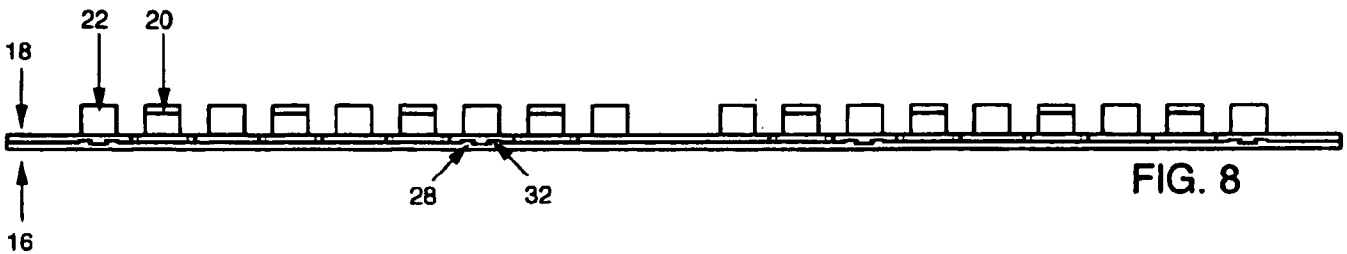
FIG. 8

BINDER

RELATED APPLICATION

This application claims priority from Provisional Application Ser. No. 60/372,989, filed Apr. 16, 2002.

BACKGROUND OF THE INVENTION

The invention generally relates to devices used for carrying paper goods and the like. More particularly, the present invention relates to a loose-leaf binder which retains perforated loose-leaves and notebook paper.

Loose-leaf binders are generally known in the art for use in receiving and retaining a sheaf of papers in an organized, orderly fashion. As one common example, conventional ring binders include a plurality of metal or plastic rings for reception through preformed perforations along one side edge of a sheaf of papers. Such ring binders are used extensively in applications wherein frequent insertion and/or removal of paper sheets from the binder is necessary or desirable. However, such binders exhibit a fixed width or thickness at the binder spine, in accordance with the size of the binder rings, in combination with a variable width or thickness at the open side of the binder in accordance with the number of contained pages. As a result, traditional ring binders do not have a uniform rectangular book-like configuration, and thus are not conducive to stacking or shelving in an orderly manner. Moreover, individual sheets contained within the binder are subject to relatively easy inadvertent tearing from the binder rings.

Alternative binder constructions have been proposed for receiving a variable thickness stack of papers with one side edge clamped securely within the spine of an adjustable binder cover. While these binder constructions beneficially accommodate compilation and binding of papers into a more rectangular book-like configuration, with reduced risk of inadvertent tearing of individual sheets form the binder, these binder constructions require multiple cover components and/or multiple paper retainer pins and related clamp or lock devices which result in a relatively complex and costly binder product.

U.S. Pat. No. 5,333,125 to Forsse et al. discloses a modular book binder which accommodates variable thickness of the bound paper so as to be generally rectangular and conducive to stacking or shelving in an orderly manner. However, such modular binder must have various components of a spine thereof disassembled in order to remove or add paper, after which the spine assembly must be reassembled.

Curled finger binders are old and well-known. Such binders include a spine and overlapping extensions in the shape of curled fingers which are inserted in corresponding rectangular perforations in the paper leaves to be bound and which overlap with one another. Conventionally, a separate uncurling tool is needed to separate the normally overlapping curled fingers, to thereby allow the paper leaves to be inserted therebetween. Once the sheets are inserted between the separated curled fingers, the uncurling tool is removed, allowing the fingers to insert into their corresponding rectangular perforations in the sheets, to encircle them and to once again overlap. This effectively binds the sheets of paper or loose leafs together, and provides them with a spine. The requirement of a separate tool to separate the curled fingers increases the complexity and cost of the binders. Moreover, the owner of the binder is not able to freely add or remove paper from the bound booklet.

U.S. Pat. No. 6,126,353 to Mullin et al., discloses a curled finger hinge binder which does not require the use of a tool. However, the fingers of the Mullin hinge binder must have a very thin cross-section to allow for the overlapping thereof so that the pages do not become bent, distorted or torn. Such overlapping fingers, which arrangement is also used in conventional loose-leaf binders, cause the pages to be hung up in the overlapped fingers as they are turned. Moreover, there appears to be no easy way to open the Mullin hinge binder once it is snapped onto the pages without the risk of breaking the binder.

Accordingly, there is a continuing need for a binder that is simple, easy to use and inexpensive. Such a binder should not require finger opening tools, and should be capable of being opened and closed easily so as to facilitate the addition and removal of pages thereto. The present invention fulfills these needs and provides other related advantages.

SUMMARY OF THE INVENTION

The present invention resides in a binder of the curled-finger type which retains perforated loose-leaves and notebook paper and which is capable of being selectively opened and closed without the need for tools so as to add and remove paper thereto.

The binder comprises a first strip having spaced-apart fingers extending upwardly therefrom. A second strip is slidably connected to the first strip and movable between open and closed positions relative to the first strip. The second strip also has spaced-apart fingers extending upwardly therefrom. Typically, the fingers are curled. Preferably, the ends of the fingers are rounded to facilitate capture and release of the papers. In the closed position, the fingers of the first and second strips are offset from one another so as to be mis-aligned, thus accepting alternating apertures of the papers.

In a particularly preferred embodiment, the first strip includes tracks formed on an upper surface thereof. The second strip includes mating tracks formed on a lower surface thereof, such that the second strip is positioned above the first strip when in the closed position. The leading edge of the second strip includes notches for receiving bases of the fingers of the first strip.

The first and second strips include releasable locking catches to retain the strips in a closed position. Such locking catches can comprise ball and detent structures formed on the first and second strips. Alternatively, the locking catches can comprise resiliently flexible flaps extending from either the first or second strip which are removable insertable into channels formed in the strips. The first and second strips also include release tabs for selectively moving the second strip into the open position to add or remove paper therefrom.

A cover is attached to a lower surface of the first strip. The cover includes living hinges, typically formed at opposing side edges of the first strip to allow the book to be opened without limitation. One or more pockets are preferably formed on an outer surface of the cover so as to accept inserts. Such inserts may comprise file hangers or printed labels.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 4 is a top plan view of a bottom strip used in accordance with the present invention;

FIG. 5 is a side elevational view of the strip of FIG. 4;

FIG. 6 is a top plan view of a top strip used in accordance with the present invention;

FIG. 7 is a side elevational view of the top strip of FIG. 6;

FIG. 8 is a side elevational view of the top and bottom strips connected to one another;

DETAILED DESCRIPTION OF THE PREFERRED EMBODIMENTS

As shown in the accompanying drawings for purposes of illustration, the present invention resides in a binder, generally referred to by the reference number 10, for receiving and retaining leaves or paper 12 having a plurality of apertures 14 formed along a side thereof, in a manner similar to existing curled-finger binders.

Figure 1:
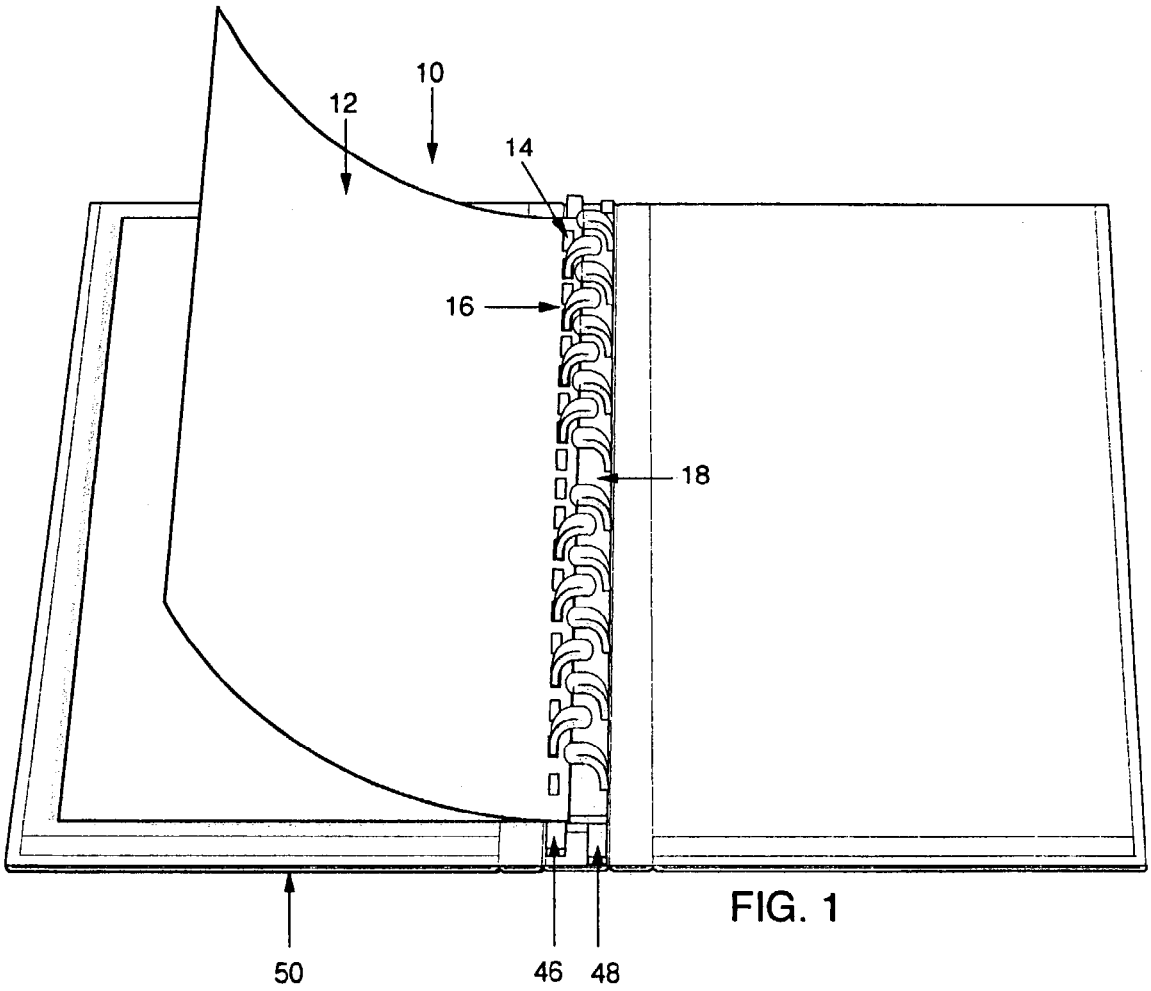
FIG. 1 is a perspective view of a binder embodying the present invention and having paper therein.
Figure 3:
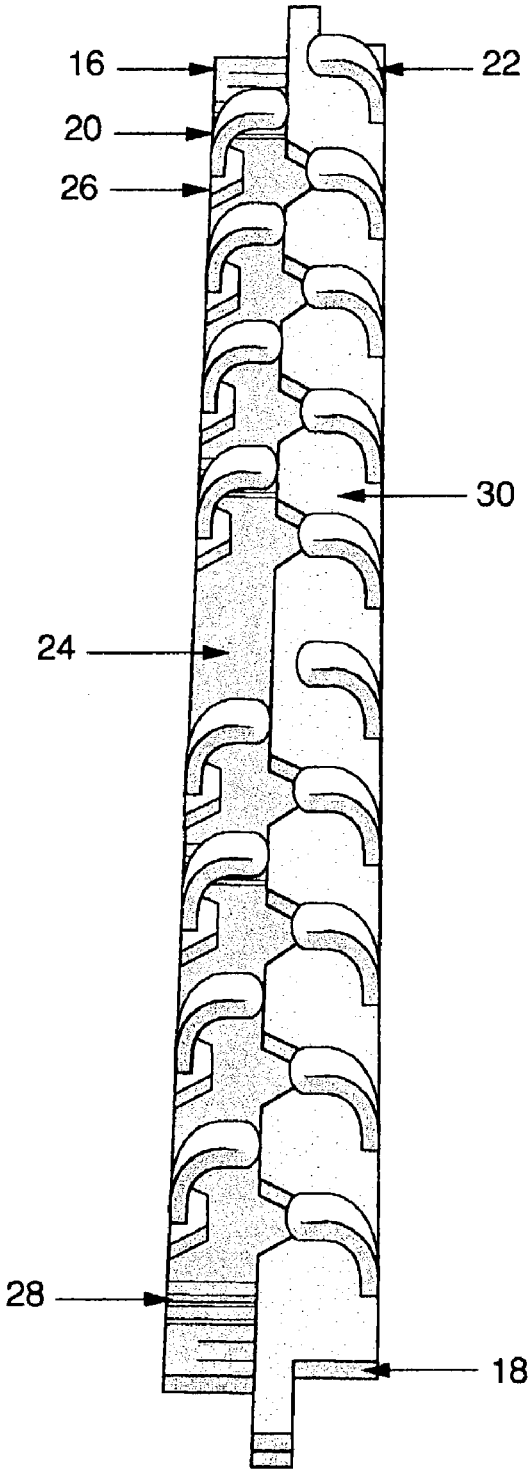
FIG. 3 is a perspective view of the two strips in a closed position.
Figure 2:
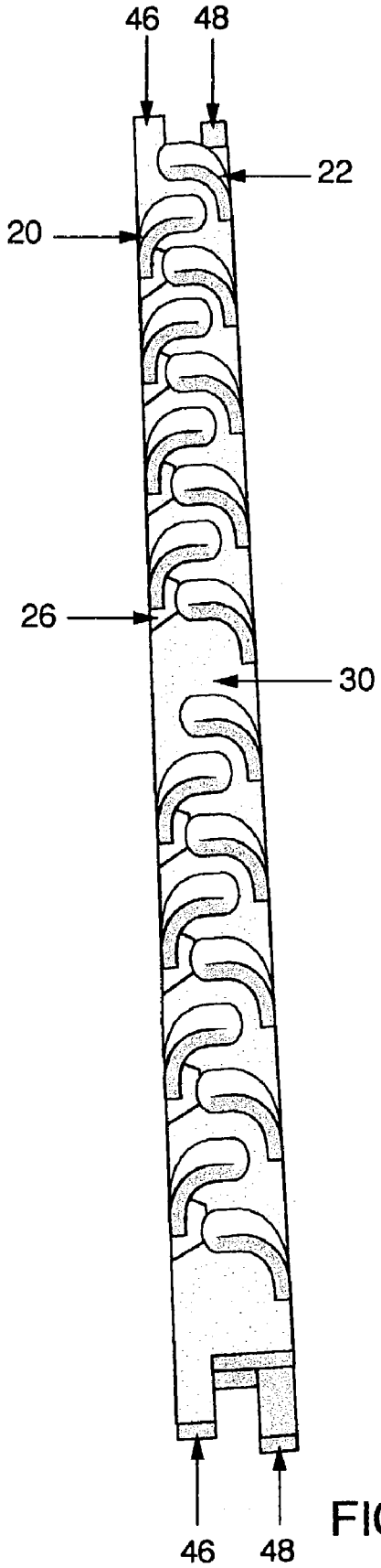
FIG. 2 is a perspective view of two strips of the binder of the present invention in an open position.

With reference now to FIGS. 1–3, the binder 10 of the present invention is comprised of a bottom strip 16 and a top strip 18 which are slidably interconnected and which serve to catch the paper 12 and retain such with respect to the binder 10. The bottom strip includes a plurality of spaced-apart fingers 20 which are curled to form quarter-ring structures. Similarly, the top strip 18 includes substantially identical fingers 22 which are also spaced-apart from one another. The strips 16 and 18 are typically comprised of plastic and injection-molded. Thus, the strips 16 and 18 are fairly inexpensive and easy to produce.

As shown in FIG. 3, the fingers 20 and 22 of the respective strips 16 and 18 do not overlap, but instead are offset and mis-aligned from one another. This allows the cross-section of each finger 20 and 22 to be much thicker than the curled fingers of prior art binders, such that they are not as subject to distortion. Preferably, the ends of each finger 20 and 22 are tapered and rounded so that as pages 12 are turned from one side to the other, they are not hung-up on the fingers 20 and 22.

With reference now to FIGS. 2–8, the bottom strip 16 includes a generally planar platform 24. The fingers 20 extend upwardly from the platform 24 and are all in the same orientation. Typically, eight spaced-apart fingers 20 extend from the platform 24. However, it will be appreciated by those skilled in the art that the number of fingers 20 and the length of the strip 16 or 18 can be modified to suit the needs of the consumer. A base 26 of the fingers 20 may provide reinforcement for the finger 20 and give a consistent geometric shape, as will be described more fully herein. Tracks 28 are formed on an upper surface of the platform 24 of the first strip 16.

The second strip 18 includes a generally planar base or platform 30 from which the fingers 22 extend upwardly and in generally the same orientation. In a particularly preferred embodiment, ten fingers 22 extend upwardly from the top strip base 30. The top strip 18 also includes tracks 32 formed on a bottom surface thereof and which are configured to be aligned with and mate with the tracks 28 of the bottom strip 16. The tracks 28 and 32 are formed such that the strips 16 and 18 can be joined to one another by sliding their respective elongated edges towards one another. Yet, the top strip 18 cannot be lifted upwardly and away from the bottom strip 16. A leading edge 34 of the top strip 18 includes notches 36 which correspond with the geometric shape of the bases 26 of the fingers 20 of the bottom strip 16, such that when the strips 16 and 18 are slidably connected, a unitary and generally rectangular spine is created, as shown in FIG. 3, such that the leading edge 34 and bases 26 engage and made with one another.

Figure 9:
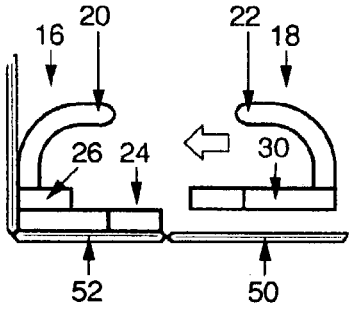
FIG. 9 is an enlarged and partially fragmented view of a top strip being connected to a bottom strip, which is attached to a cover of the binder.
Figure 10:
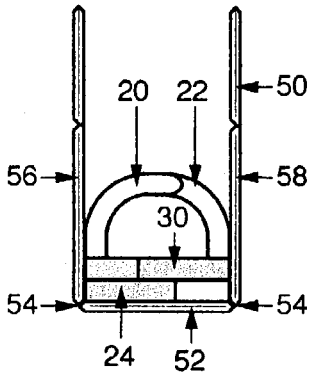
FIG. 10 is an enlarged elevational view of the strips in closed relation, and the cover of the binder also in a closed position.

With reference now to FIGS. 8–10, the interconnection of the top and bottom strips 16 and 18 is illustrated. The width of the spines 16 and 18 determines the amount of leaves or paper which can be held by the binder 10.

With reference now to FIGS. 4–7, the strips 16 and 18 include releasable locking means, such as catches, to retain the strips 16 and 18 in a closed position. Such locking catches, as illustrated, comprise a ball 38 or other protrusion extending upwardly from the platform 24 of the first strip 16 which is received within a detent 40 of the second strip 18. The invention may also utilize a resiliently flexible flap 42 having a free end thereof biased in an upward orientation. A channel 44 or catch is formed in the upper strip 18 and which is configured to align with and receive the flap 42 such that the strips 16 and 18 lock with one another when pressed together, as shown in FIG. 2, to close the fingers 20 and 22 with respect to one another. Of course, it will be appreciated by those skilled in the art that other locking means could be incorporated such that the lower and upper strips 16 and 18 be locked in closed position.

The strips 16 and 18 also includes means for releasing one another such that the strips 16 and 18 can be pulled away from one another so as to open the fingers 20 and 22 for the additional removal of paper 12 within the binder 10. Typically, as illustrated, elongated release tabs 46 and 48 extend from the ends of the strips 16 and 18. When in the closed position, as illustrated in FIG. 3, the release tabs 46 and 48 are spaced from one another. By releasing the catch means, such as by the application of downward pressure on either the flap 42 or ball 38, and applying pressure such that the release tabs 46 and 48 are moved towards one another, as illustrated in FIG. 3, the upper strip 18 is moved away from the lower strip 16 and the binder opened.

With reference to FIG. 1, paper 12 is added to the binder 10 by inserting the fingers 20 or 22 into the apertures 14 of the paper 12. As shown in FIG. 1, every other aperture is caught by either set of fingers 20 or 22. Each page 12 is allowed to lay flat and to sling from one side of the binder 10 to the other, wherein the opposing fingers 20 or 22 will engage and catch the alternate apertures 14. Paper 12 can be easily removed or added by pressing the release tabs 46 and 48 such that the upper strip 18 slides away from the lower strip 16 and sufficient space is created between the fingers 20 or 22 to add or remove the pages 12. The strips 16 and 18 can then be closed and locked in place, as described above to prevent the pages 12 from being inadvertently removed.

Figure 11:
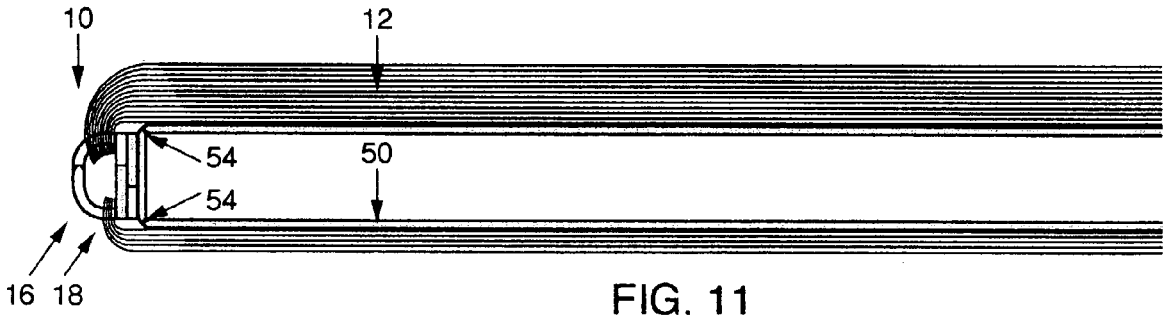
FIG. 11 is a top plan view of a binder embodying the present invention having the cover, and pages thereof, in a completely open position.

With reference now to FIGS. 9 and 10, a cover 50 has a central spine portion 52 thereof attached, such as by lamination, to a lower surface of the lower strip 16 platform 24. The cover 50 provides an esthetically appealing and protective covering for the pages 12 within the binder 10. Preferably, the cover 50 includes at least one set of living hinges 54, such as by scoring the laminated over 50 on either side of the elongated edge of the platform 24 of the lower strip 16. This enables the opposing flaps 56 and 58 of the cover 50 to be opened completely until residing substantially parallel to one another, as illustrated in FIG. 11. This can be useful as the information contained on the pages 12 of the binder 10 can be viewed in smaller spaces by folding the binder 10 over, as illustrated in FIG. 11. Also, this can enable a teacher to read a story while viewing one side of the open binder 10 while the children in the class view a corresponding picture on an opposite side of the open binder 10. Pop-up techniques can be used to increase the level of interactivity between the teacher and students wherein pop-up figures can be manipulated by the teacher as the story progresses to capture the attention of the students. Other living hinges may be formed in the cover 50 as needed.

Figure 12:
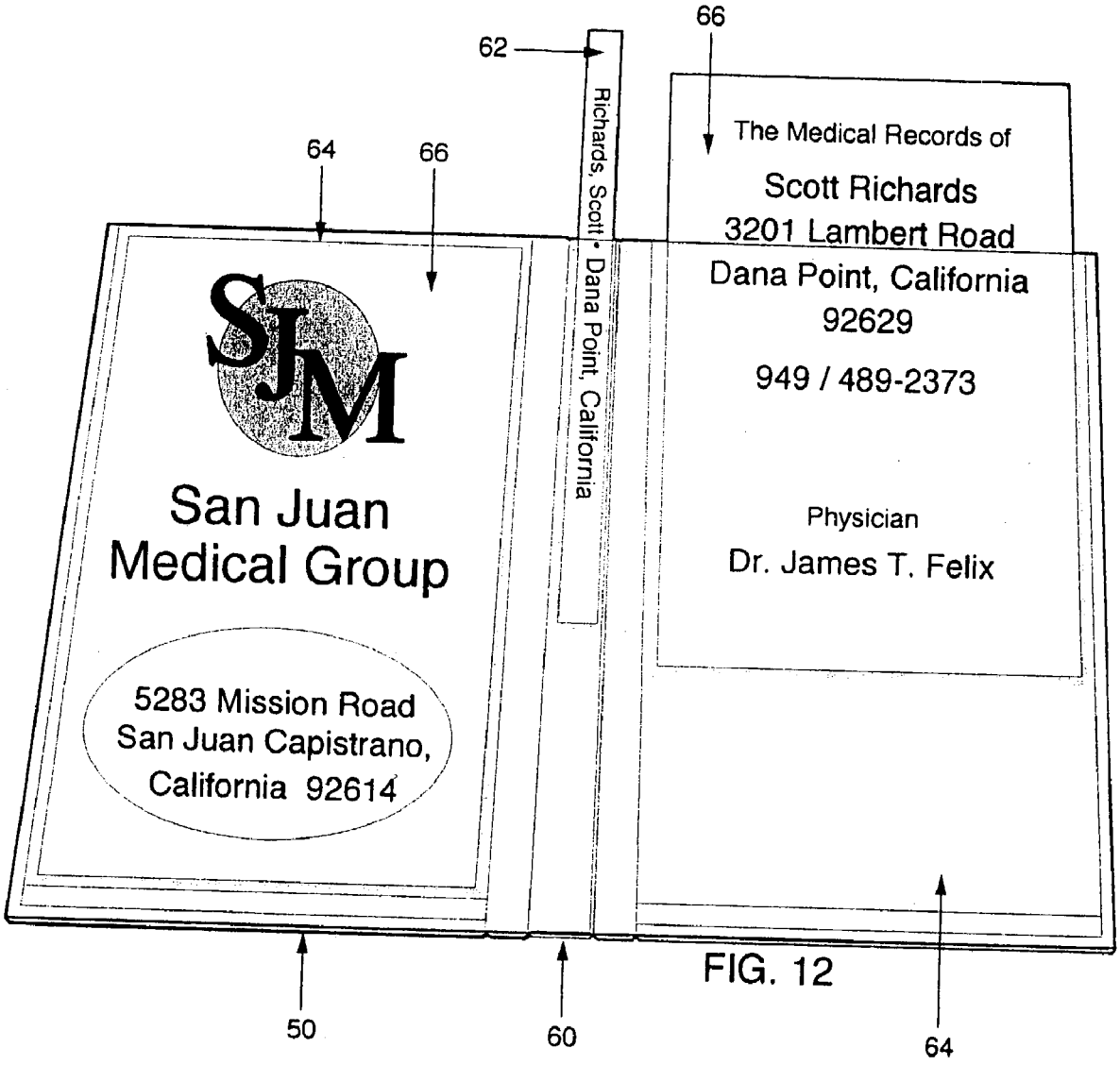
FIG. 12 is a top plan view of an outer or top surface of the cover, illustrating labeled inserts inserted into pockets thereof.
Figure 13:
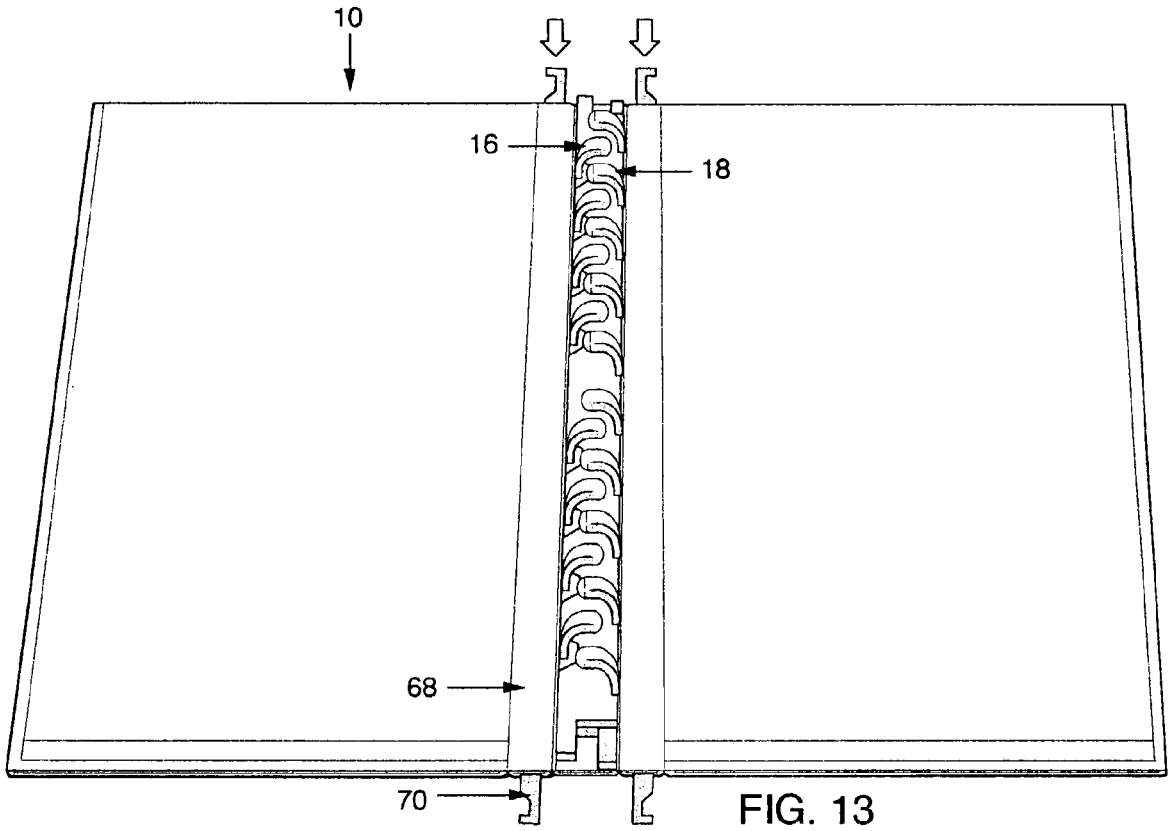
FIG. 13 is a top plan view of the binder of the present invention, having file hangers disposed in pockets thereof for hanging in a filing cabinet.

With reference now to FIGS. 12 and 13, the cover 50 includes pockets formed therein. With particular reference to FIG. 12, a pocket 60 may be formed along the spine of the cover, such as by sonic welding a thin, transparent piece of plastic to the spine 52. This enables identifying printed labels 62 and the like to be removably inserted therein for identifying the contents of the binder 10. Thus, when the binder 10 is placed on the shelf, the contents thereof can be easily identified. Similar pockets 64 can be created on the opposing outer surfaces of the cover for the removable insertion of face labels which may be of various sizes so that the contents of the binder 10 can be readily ascertained when viewing a top or back surface of the binder 10. Side pockets 68 formed along the spine 52 of the cover 50 may be formed which are configured to removably receive file cabinet hangers 70, as illustrated in FIG. 13. Thus, the binder 10 can be hung in a filing cabinet.

The outside thickness of the binder 10 of the present invention can be as small as one-half inch. The thin profile of the inexpensive binder 10, combined with the ability of its pages to lay flat, makes it ideal for the record-keeping needs of doctors, dentists, hospitals, etc. The configuration of the binder 10 of the present invention is also perfect for booklet presentations of all kinds. No special tools are required to open or close the binder for the addition or removal of paper. Once closed, the strips 16 and 18 can be easily opened manually to add or remove paper as needed.

Although several embodiments have been described in detail for purposes of illustration, various modifications may be made without departing from the scope and spirit of the invention. Accordingly, the invention is not to be limited, except as by the appended claims.

What is claimed is:

1. A binder for receiving and retaining papers having a plurality of apertures formed along a side thereof, the binder comprising:

a first strip having spaced-apart fingers extending upwardly therefrom; and a second strip slidably connected to the first strip and movable between open and closed positions relative to the first strip, the second strip having spaced-apart fingers extending upwardly therefrom, wherein the fingers of the first and second strips are offset from one another so as to be mis-aligned when the first and second strips are in closed relation so as to accept alternating apertures of the papers;

wherein the first and second strips include mating tracks; and wherein the first strip includes tracks formed on an upper surface thereof, and wherein the second strip includes mating tracks formed on a lower surface thereof, such that the second strip is positioned above the first strip in the closed position.

2. The binder of claim 1, including a cover attached to a lower surface of the first strip.

3. The binder of claim 1, wherein the fingers of the first and second strips are curled.

4. The binder of claim 3, wherein ends of the fingers are rounded to facilitate capture and release of the papers.

5. A binder for receiving and retaining papers having a plurality of apertures formed along a side thereof, the binder comprising:

a first strip having spaced-apart fingers extending upwardly therefrom; and a second strip slidably connected to the first strip and movable between open and closed positions relative to the first strip, the second strip having spaced-apart fingers extending upwardly therefrom, wherein the fingers of the first and second strips are offset from one another so as to be mis-aligned when the first and second strips are in closed relation so as to accent alternating apertures of the papers;

wherein the first and second strips include releasable locking catches to retain the strips in a closed position; and wherein the locking catches comprise ball and detent structures formed on the first and second strips.

6. A binder for receiving and retaining papers having a plurality of apertures formed along a side thereof, the binder comprising:

a first strip having spaced-apart fingers extending upwardly therefrom; and a second strip slidably connected to the first strip and movable between open and closed positions relative to the first strip, the second strip having spaced-apart fingers extending upwardly therefrom, wherein the fingers of the first and second strips are offset from one another so as to be mis-aligned when the first and second strips are in closed relation so as to accept alternating apertures of the papers;

wherein the first and second strips include releasable locking catches to retain the strips in a closed position; and wherein the locking catches comprise resiliently flexible flaps extending from the first or the second strip and removably insertable into channels formed in the first or the second strip.

7. A binder for receiving and retaining papers having a plurality of apertures formed along a side thereof, the binder comprising:

a first strip having spaced-apart fingers extending upwardly therefrom; and a second strip slidably connected to the first strip and movable between open and closed positions relative to the first strip, the second strip having spaced-apart fingers extending upwardly therefrom, wherein the fingers of the first and second strips are offset from one another so as to be mis-aligned when the first and second strips are in closed relation so as to accept alternating apertures of the papers; and a cover attached to a lower surface of the first strip;

wherein the cover includes living hinges.

8. The binder of claim 7, wherein the living hinges are formed at opposing side edges of the first strip.

9. A binder for receiving and retaining papers having a plurality of apertures formed along a side thereof, the binder comprising:

a first strip having spaced-apart fingers extending upwardly therefrom; and a second strip slidably connected to the first strip and movable between open and closed positions relative to the first strip, the second strip having spaced-apart fingers extending upwardly therefrom, wherein the fingers of the first and second strips are offset from one another so as to be mis-aligned when the first and second strips are in closed relation so as to accent alternating apertures of the papers;

wherein a leading edge of the second strip includes notches for receiving bases of the fingers of the first strip.

10. A binder for receiving and retaining papers having a plurality of apertures formed along a side thereof, the binder comprising:

a first strip having spaced-apart curled fingers extending upwardly therefrom; and a second strip slidably connected to the first strip and movable between open and closed positions relative to the first strip, the second strip having spaced-apart curled fingers extending upwardly therefrom, wherein the fingers of the first and second strips are offset from one another so as to be mis-aligned when the first and second strips are in closed relation so as to accept alternating apertures of the papers; and a cover attached to a lower surface of the first strip and having living hinges formed at opposing side edges of the first strip;

wherein the first strip includes tracks formed on an upper surface thereof, and wherein the second strip includes mating tracks formed on a lower surface thereof, such that the second strip is positioned above the first strip in the closed position;

wherein the first and second strips include releasable locking catches to retain the strips in a closed position; and wherein the first and second strips include release tabs for selectively moving the second strip into an open position.

11. The binder of claim 10, wherein ends of the fingers are rounded to facilitate capture and release of the papers.

12. The binder of claim 10, wherein the locking catches comprise ball and detent structures formed on the first and second strips.

13. The binder of claim 10, wherein the locking catches comprise resiliently flexible flaps extending from the first or the second strip and removably insertable into channels formed in the first or the second strip.

14. The binder of claim 10, wherein a leading edge of the second strip includes notches for receiving bases of the fingers of the first strip.

15. The binder of claim 10, wherein the cover includes a pocket formed on an outer surface thereof configured to accept inserts.

16. A binder for receiving and retaining papers having a plurality of apertures formed along a side thereof, the binder comprising:

a first strip having spaced-apart fingers extending upwardly therefrom; and a second strip slidably connected to the first strip and movable between open and closed positions relative to the first strip, the second strip having spaced-apart fingers extending upwardly therefrom, wherein the fingers of the first and second strips are offset from one another so as to be mis-aligned when the first and second strips are in closed relation so as to accept alternating apertures of the papers;

wherein the first strip and second strips include release tabs for selectively moving the second strip into an open position;

wherein pressing the release tabs towards one another moves the second strip away from the first strip and into an open position; and wherein pressing the first and second strips towards one another moves the second strip towards the first strip and into a closed position.

17. A binder for receiving and retaining papers having a plurality of apertures formed along a side thereof, the binder comprising:

a first strip having a lower portion, a central portion, and an upper portion, the upper and lower portions each having at least two spaced-apart fingers extending upwardly therefrom, and the central portion not including any upwardly extending fingers; and a second strip slidably connected to the first strip and movable between open and closed positions relative to the first strip, the second strip having a lower portion, a central portion, and an upper portion corresponding to the respective lower portion, central portion and upper portion of the first strip, the upper and lower portions of the second strip each including at least two spaced-apart fingers extending upwardly therefrom, and the central portion of the second strip not including any upwardly projecting fingers;

wherein the fingers of the first and second strips are offset from one another so as to be mis-aligned when the first and second strips are in closed relation so as to accept alternating apertures of the papers.

* * * * *